US011399650B2

(12) United States Patent
Ko

(10) Patent No.: US 11,399,650 B2
(45) Date of Patent: Aug. 2, 2022

(54) RIPPLEFOLD DRAPERY CARRIER SYSTEM

(71) Applicant: Hou Sheng Ko, Irvine, CA (US)

(72) Inventor: Hou Sheng Ko, Irvine, CA (US)

( * ) Notice: Subject to any disclaimer, the term of this patent is extended or adjusted under 35 U.S.C. 154(b) by 180 days.

(21) Appl. No.: 16/227,388

(22) Filed: Dec. 20, 2018

(65) Prior Publication Data

US 2020/0196790 A1 Jun. 25, 2020

(51) Int. Cl.
*A47H 15/02* (2006.01)
*A47H 13/01* (2006.01)

(52) U.S. Cl.
CPC ..... *A47H 15/02* (2013.01); *A47H 13/01* (2013.01)

(58) Field of Classification Search
CPC ..... A47H 5/02; A47H 5/032; A47H 13/01; A47H 13/14; A47H 15/00; A47H 15/02; A47H 15/04; E06B 9/362; E06B 9/367; Y10T 16/35; Y10T 16/353; Y10T 16/372; Y10T 16/37; Y10T 16/375; Y10T 16/364
See application file for complete search history.

(56) References Cited

U.S. PATENT DOCUMENTS

| | | | | |
|---|---|---|---|---|
| 3,951,196 | A * | 4/1976 | Salzmann | A47H 1/04 160/345 |
| 5,611,385 | A * | 3/1997 | Hsu | E06B 9/362 160/173 V |
| 6,675,858 | B2 * | 1/2004 | Marocco | A47H 23/06 160/168.1 V |
| 9,943,184 | B1 * | 4/2018 | Kao | A47H 5/032 |
| 2009/0255086 | A1 * | 10/2009 | Wicker | A47H 13/04 16/87.8 |
| 2009/0301668 | A1 * | 12/2009 | Kirby | A47H 5/0325 160/341 |
| 2012/0145860 | A1 * | 6/2012 | Ruffo | A47H 13/00 248/251 |

* cited by examiner

*Primary Examiner* — Daniel P Cahn
*Assistant Examiner* — Matthew R. Shepherd
(74) *Attorney, Agent, or Firm* — Leavitt Eldredge Law Firm

(57) ABSTRACT

A drapery carrier system includes a master carrier, having a body extending from a first end to a second end, the body to receive a snap tape; a plate attached to the body, the plate extending from a first end to a second end, the plate having a cutout groove extending into the plate from the first end; and wheels attached to the plate and to engage with a track; a master cap having a hole extending therethrough to receive a cable, the master cap to engage with the cutout groove such that the cable is thereby attached to the master carrier; the master carrier engages with the cable and the track to receive and support drapery thereon.

7 Claims, 9 Drawing Sheets

RIPPLEFOLD DRAPERY CARRIER SYSTEM

BACKGROUND

1. Field of the Invention

The present invention relates generally to ripple drapery systems, and more specifically, to a ripplefold drapery carrier system with a novel master body, a novel two piece ripple fold carrier, and a novel snap pendant for a gliding wheels carrier. The system of the present invention provides for an improved ripplefold drapery carrier system that does not require force demolding from the top or from the front and back.

2. Description of Related Art

Ripple drapery systems are well known in the art and are effective means to hang drapery. Conventional systems can include a number of devices that engage with a track and/or cable and receive drapery, thereby allowing for the drapery to be opened and closed. Further, conventional systems can include snap pendants that allow for a snap device to be engaged therewith, thereby allowing for easy installation of drapery after installation of the devices along the track and cable.

One of the problems commonly associated with conventional drapery systems is the need to remove the drapery without causing damage to any of the installation devices.

It is an object of the present invention to provide a ripple drapery system that utilizes one or more of a novel master carrier, a novel gliding wheels carrier, and a novel two piece ripplefold carrier.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
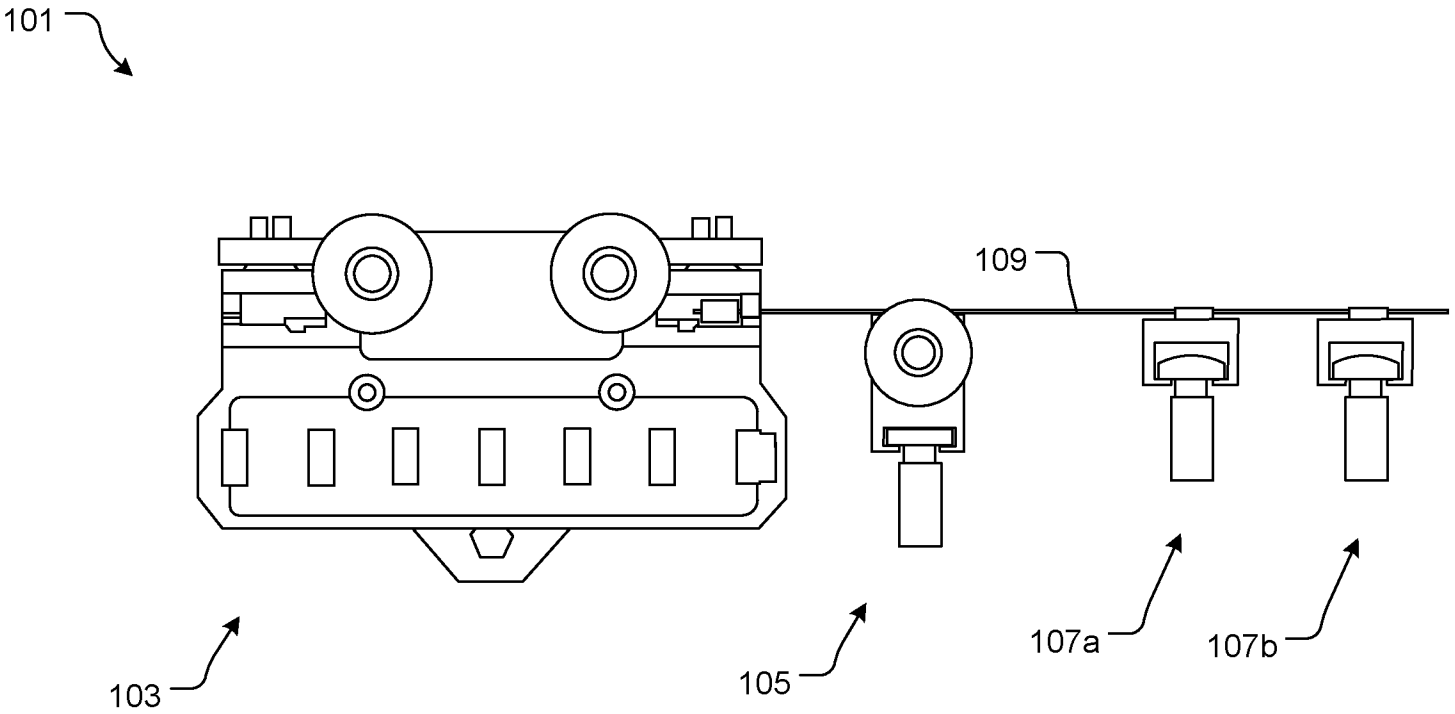
FIG. 1 is a simplified side view of a drapery a ripplefold drapery carrier system in accordance with the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional drapery carrier systems. Specifically, the present invention provides for improved functionality of a master carrier, a two point ripplefold carrier, and an improved snap pendant of a gliding wheels carrier. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a simplified side view of a drapery carrier system 101 in accordance with a preferred embodiment of the present application. It will be appreciated that system 101 overcomes one of more of the problems commonly associated with conventional drapery carrier systems.

In the contemplated embodiment, system 101 includes one or more of a master carrier 103, a two piece ripplefold carrier 105, and gliding wheels carriers 107*a-b*. It should be appreciated that the system includes one or more of these devices that can be used together or separately. The system is configured to receive drapery and engage with a track (not shown) and a cable 109.

Figure 2:
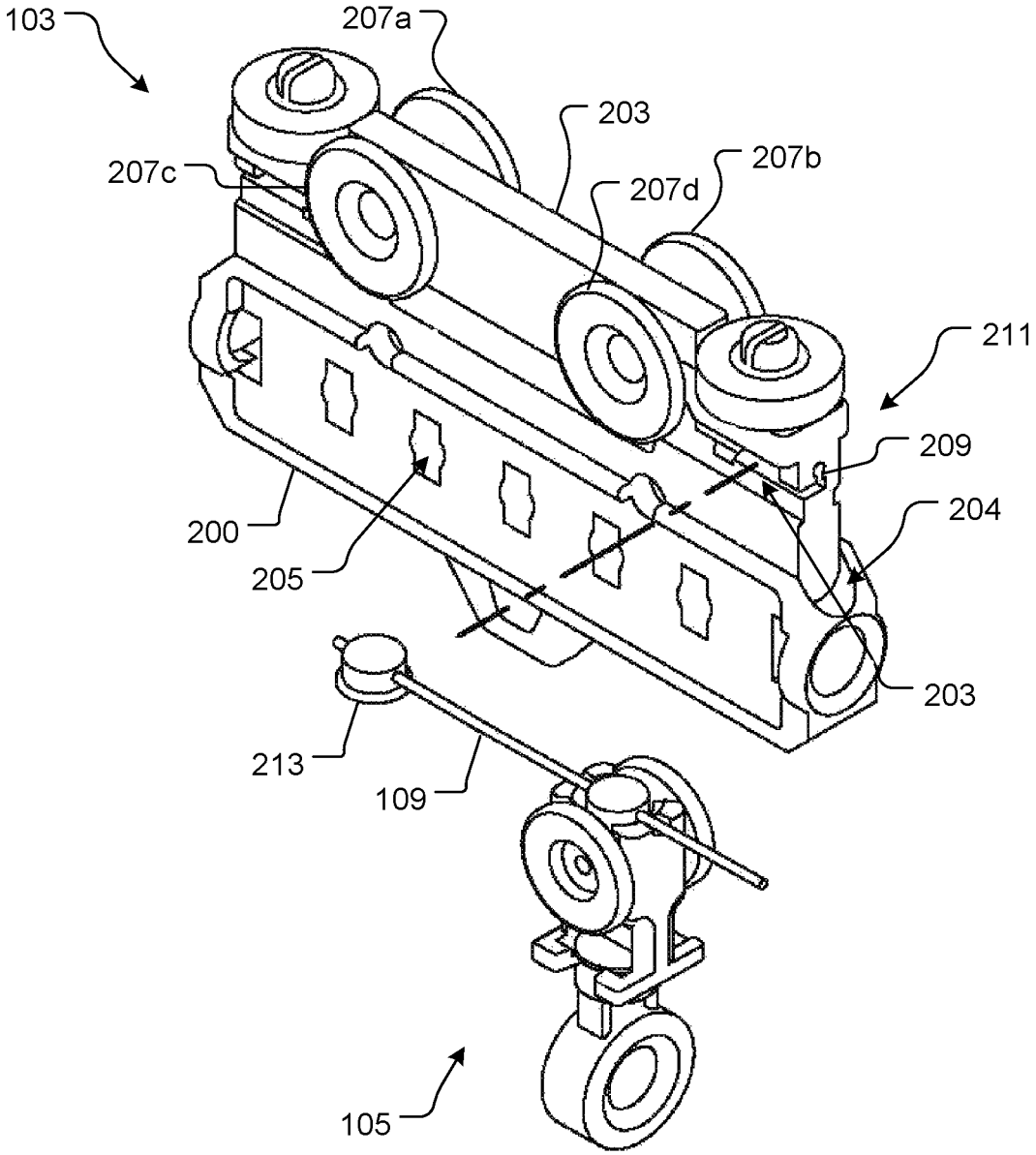
FIG. 2 is an oblique view of a master carrier and two piece ripplefold carrier of FIG. 1.

In FIG. 2, an oblique view depicts master carrier 103, ripplefold carrier 105, and cable 109. In the preferred embodiment, the master carrier 103 includes a master carrier body 200 and a plate 203 connected thereto. It should be appreciated that the size and materials of the body 200 and plate 203 can vary. As shown, in one embodiment, the plate 203 is connected within a groove 204 of body 200, however, it is contemplated that the two can be one solid piece. The body 200 further includes a plurality of holes 205 extending therethrough and includes a plurality of wheels 207*a-d* configured to engage with a track 501.

Figure 3:
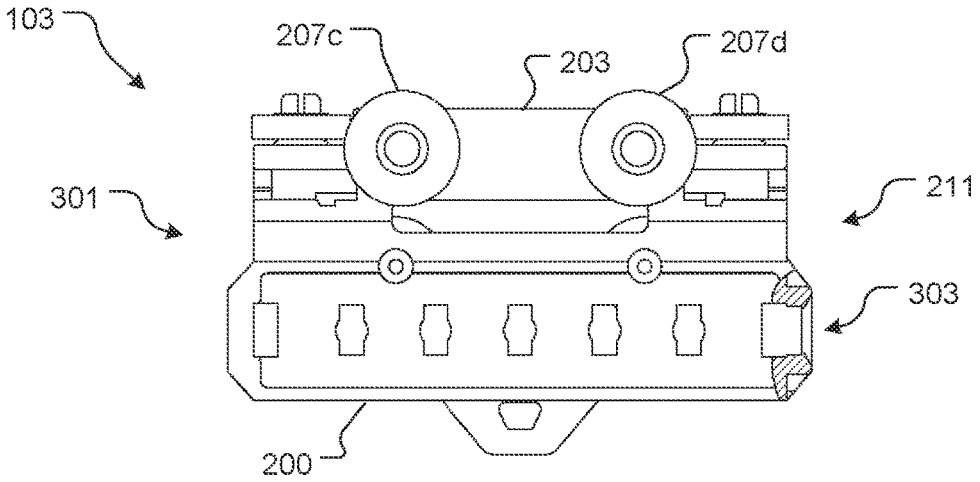
FIG. 3 is a side view of the master carrier of FIG. 1.
Figure 4:
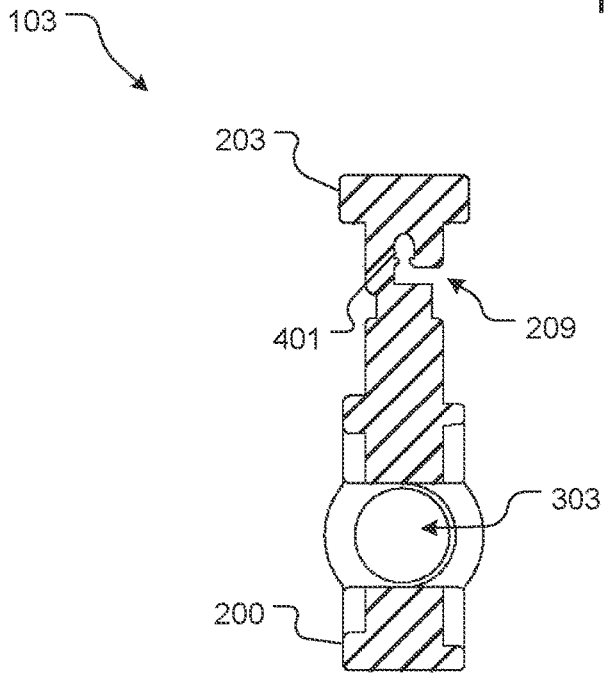
FIG. 4 is a cross sectional view of a master carrier body and plate of FIG. 3.
Figure 5:
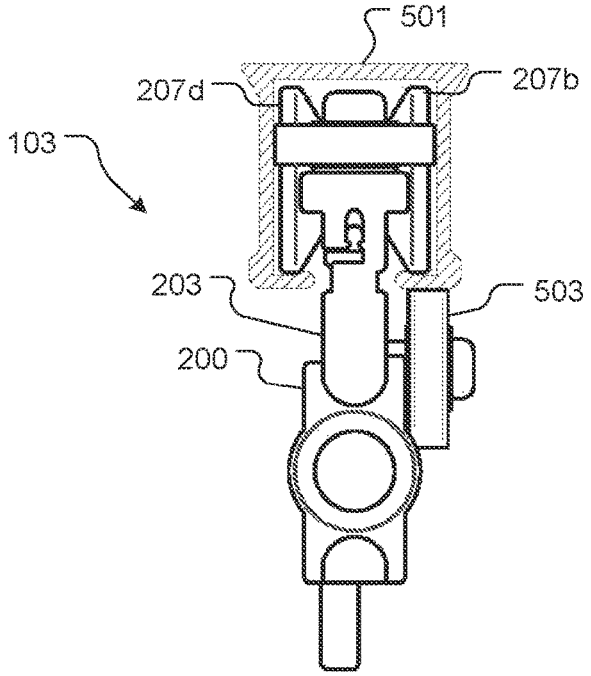
FIG. 5 is an end view of the master carrier of FIG. 1 engaged with a track.

One of the unique features believed characteristic of the present invention is a cutout groove 209 extending from an end 211 of plate 203. This cutout groove 209 is configured to receive a master cap 213 with cable 109, thereby allowing for easy engagement of the cable with the master carrier 103. As shown, in one embodiment, the cutout groove is L shaped, however, alternative embodiments contemplate alternative shapes. In FIG. 3, a simple side view of master carrier 103 is show, wherein body 200 and plate 203 extend from end 211 to end 301 and include snap end 303 for receiving a snap to install drapery In FIG. 4, a cross sectional view taken from end 211 is shown, further depicting cutout groove 209, wherein the groove 209 ends in a circular opening 401. In FIG. 5, an end view of master carrier 103 is shown, wherein the top wheels 207*d*, 207*b* are engaged with track 501. Further attached to body 200 are bottom wheels 503, which engage with the track 501 to provide for smooth and nearly silent movement of the master carrier and the drapery attached thereto. This feature is believed to be another novel feature, wherein the master carrier provides for improved traversing within the track.

Figure 6:
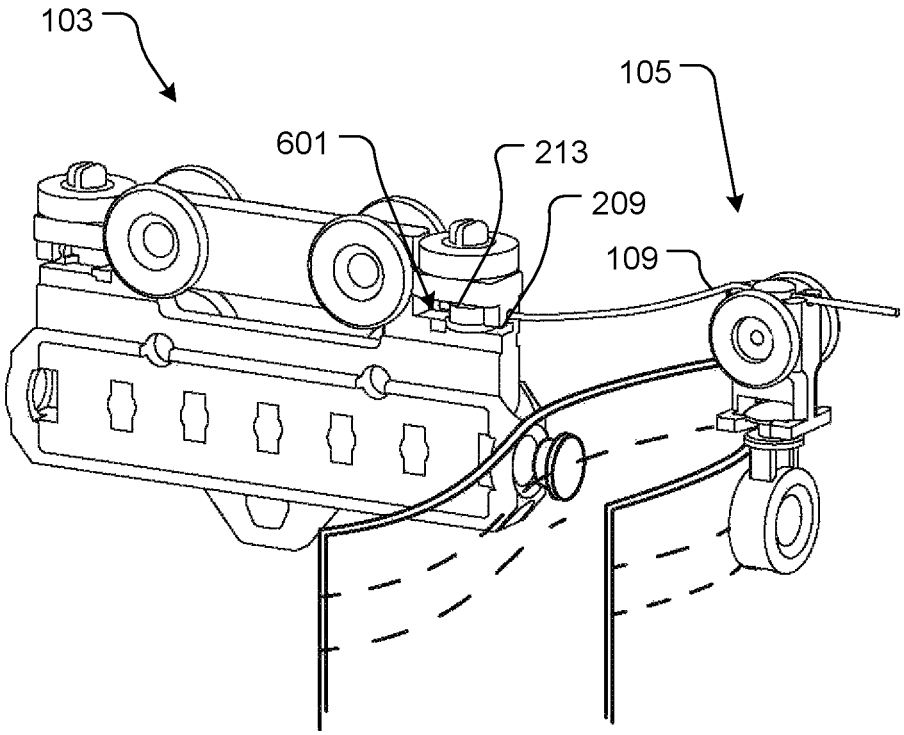
FIG. 6 is an oblique view of the master carrier of FIG. 1 and the ripplefold carrier of FIG. 1 with a cable extending therebetween.

In FIG. 6, yet another oblique view depicts master carrier 103 and ripplefold carrier 105 with cable 109 extending therebetween. This figure further depicts the engagement of master cap 213 with opening 601 and cutout groove 209. Again, it should be appreciated that this feature provides for easy installation of the cable 109 to the master carrier.

Figure 7:
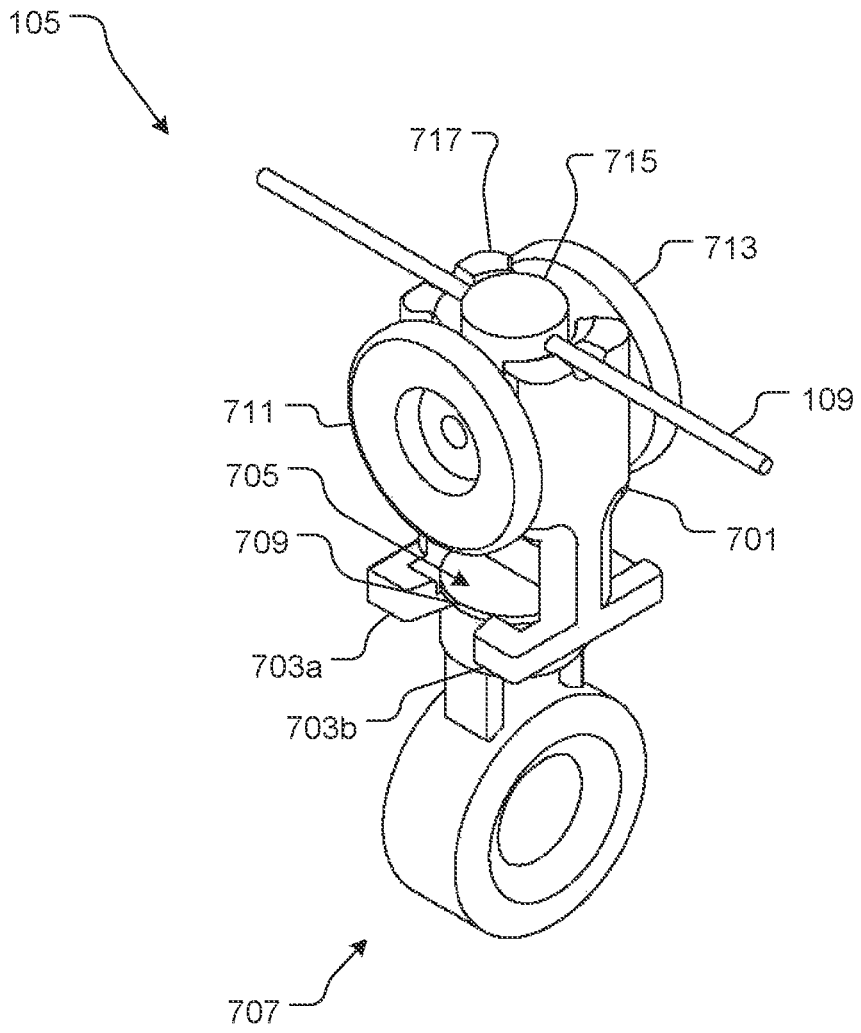
FIG. 7 is an oblique view of the ripplefold carrier of FIG. 1.

In FIG. 7, an oblique view of the ripplefold carrier 105 is shown engaged with cable 109. Ripple fold carrier 105 including a carrier body 701 with grooves 703*a-b* forming an opening 705 to receive a pendant 707 with a flange 709 via a horizontal, side to side motion. In this embodiment, a first wheel 711 and a second wheel 713 attached to opposing sides of the carrier to engage with the track; and a carrier cap 715 with a hole extending therethrough to receive the cable is configured to engage with a top 717 of the body 701.

Figure 8:
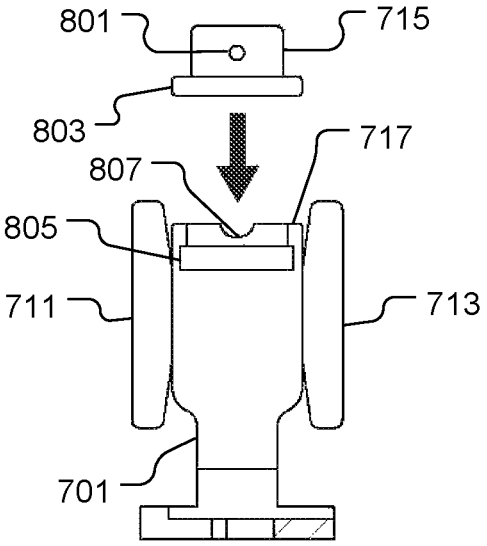
FIG. 8 is an end view of the ripplefold carrier of FIG. 1 demonstrating attachment of the ripplefold carrier cap.
Figure 9:
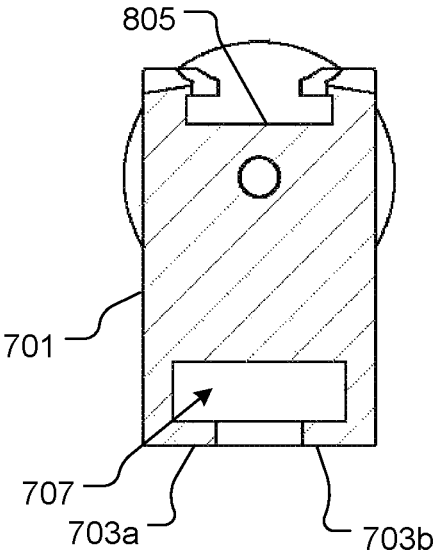
FIG. 9 is a cross sectional view of the ripplefold carrier body of FIG. 7.

In FIG. 8, an end view of ripplefold carrier 105 without the pendant is shown. As shown, the carrier cap 715 includes hole 801 and a lip 803 configured to engage with a slot 805 disposed in body 701. Further shown is a groove 807 to receive the cable. In FIG. 9, a cross sectional view of body 701 is show for clarity.

It should be appreciated that another unique feature believed characteristic of the present application is the horizontal engagement of the pendant with the ripplefold carrier body, thereby allowing for the two to be disengaged and engaged easily and efficiently.

Figure 10:
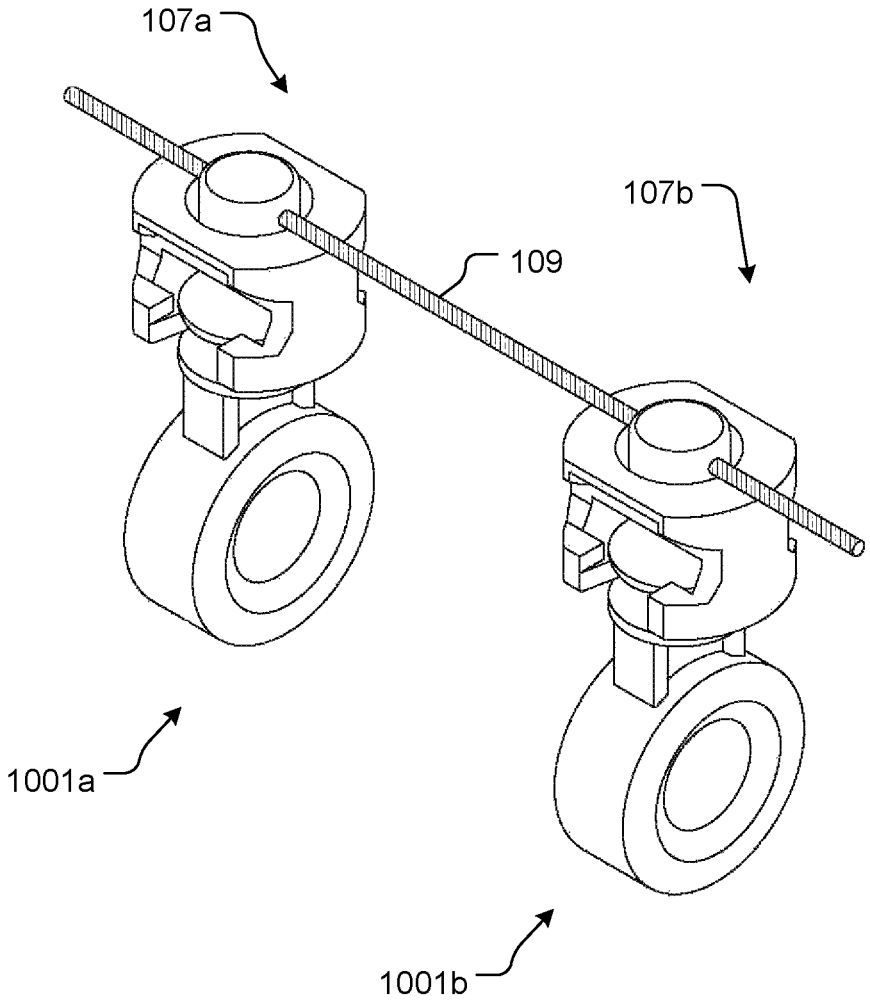
FIG. 10 is an oblique view of two gliding wheels carriers of FIG. 1 engaged with the cable.
Figure 11:
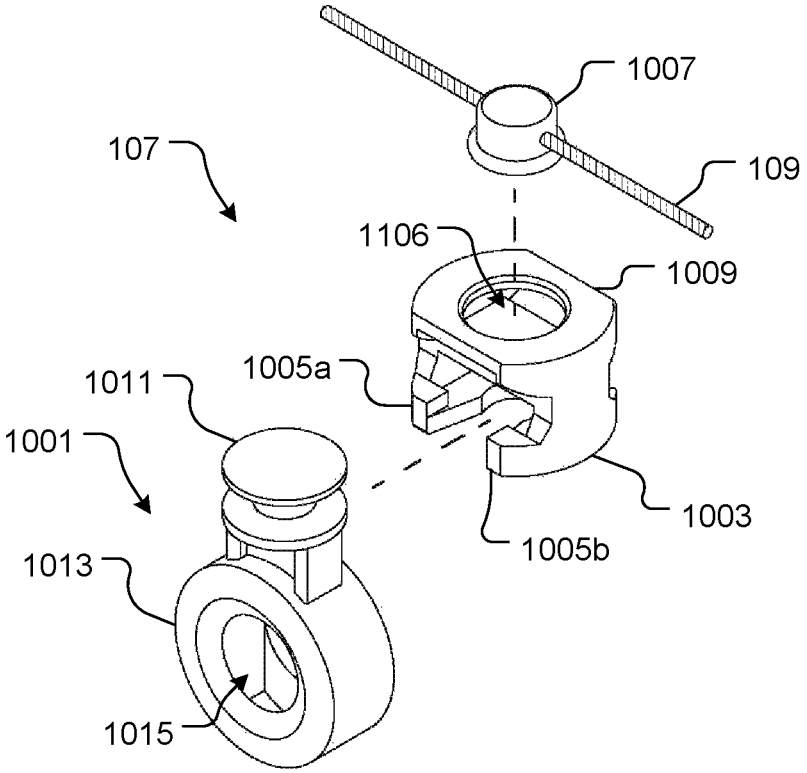
FIG. 11 is a deconstructed oblique view of one gliding wheels carrier of FIG. 1.

In FIG. 10, an oblique view depicts two gliding wheels carriers 107 engaged with cable 109. As better shown in FIGS. 11-12, each carrier 107 includes a snap pendant 1001*a-b* engaged with a carrier body 1003 with grooves 1005*a-b*. The carrier 107 further includes a carrier cap 1007 configured to engage with a top 1009 of the body 1003 and engage with the cable 109. The snap pendant 1001*a-b* includes a flange 1011 to engage with the grooves 1005*a-b*, the snap pendant 1001*a-b* having a pendant body 1013 forming a socket 1015 to receive a post of a snap device to secure the drapery thereto. It should be appreciated that the snap pendant horizontally engages with the carrier body. The cap 1007 is configured to engage with opening 1106 of body 1003.

Figure 12A:
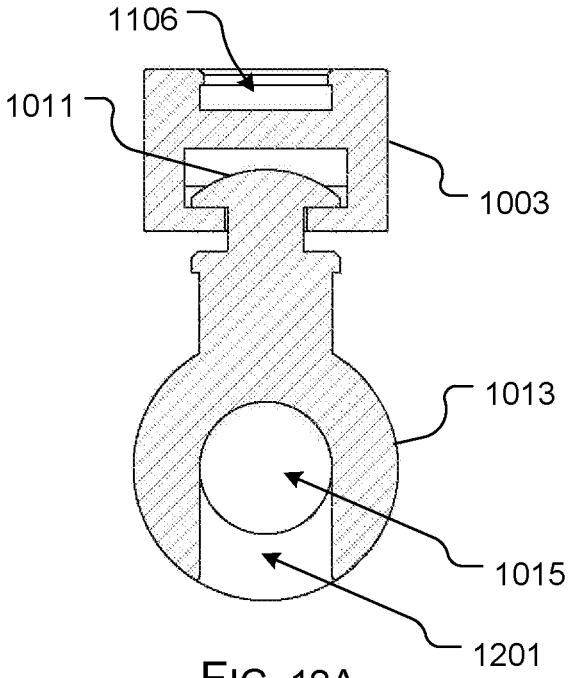
FIG. 12A is a first cross sectional view of the gliding wheels carrier of FIG. 1.
Figure 12B:
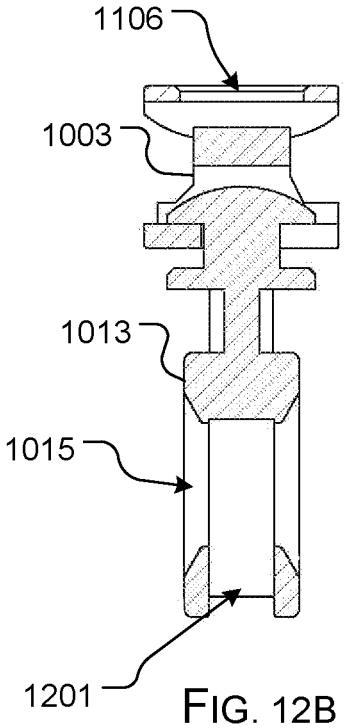
FIG. 12B is a second cross sectional view of the gliding wheels carrier of FIG. 1.
Figure 13:
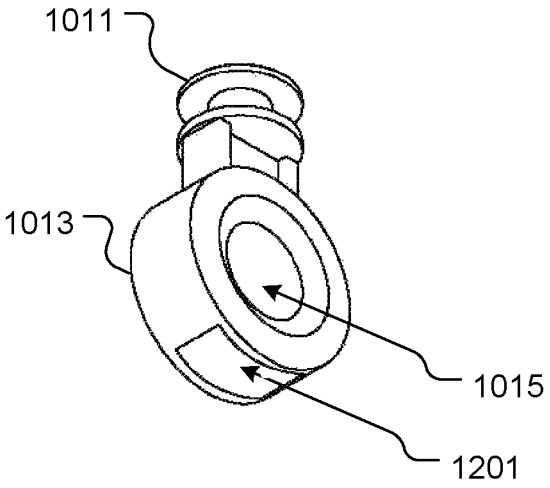
FIG. 13 is an oblique view of a pendant associated with the system of the present invention.
Figure 14:
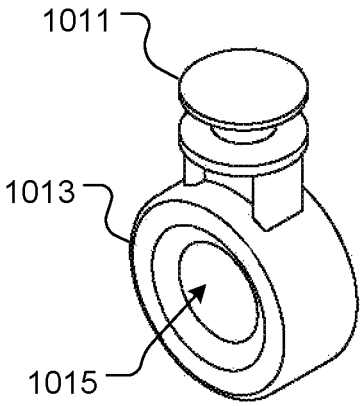
FIG. 14 is an oblique view of the pendant of FIG. 13.
Figure 15:
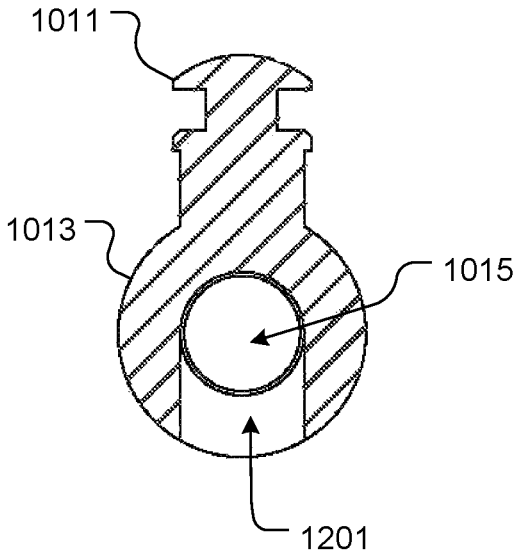
FIG. 15 is a front cross sectional view of the pendant of FIG. 13.
Figure 16:
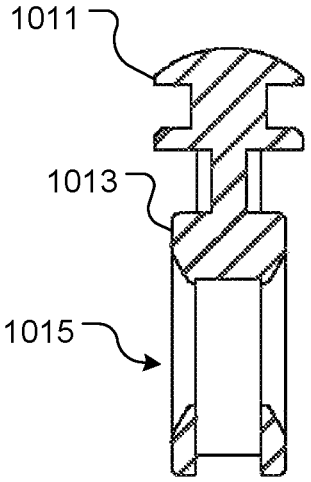
FIG. 16 is a side cross sectional view of the pendant of FIG. 13.

As shown in FIG. 12A, the snap pendant 1001 further includes an opening 1201 into socket 1015 thereby allowing for easy release of the snap feature via a bottom of the snap pendant. FIGS. 13-15 further depict the snap pendant 1001 for clarity. It should be appreciated that another unique feature believed characteristic of the present application is the snap pendant, which allows for the bottom release feature.

It should be appreciated that the size and materials of the features discussed herein can vary as aesthetical, functional, or manufacturing considerations require.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A drapery carrier system, comprising:

a master carrier, having:

a body extending from a first end to a second end and having a top end that extends between the first end and the second end;

a plate attached to the top end of the body, the plate having a first side and a second side both extending from a first plate end to a second plate end, the first plate end having a front surface that extends perpendicular from the top end of the body and a top plate end that extends away perpendicularly from the front surface and parallel to the top end of the body;

a substantially L shaped cutout groove, the substantially L shaped cutout groove having a first portion extending inwardly and horizontally from the first side of the plate and a second portion extending perpendicular and upwards from the first portion and inwardly from the front surface of the plate, thereby creating a substantially L shape; and four vertical wheels attached to the plate and configured to engage with a track, the four vertical wheels attached as a first pair to the first side of the plate and a second pair to the second side of the plate;

a master cap having a circular body with a hole extending therethrough through which a cable extends, the master cap engages with the substantially L shaped cutout groove such that the cable is thereby attached to the master carrier;

wherein the first portion of the substantially L shaped cutout groove includes a first length and a second length, the first length having a cutout height greater than a cutout height of the second length, thereby allowing for the master cap to fit through the first length and not fit through the second length; and wherein the master carrier engages with the cable and the track to receive and support a drapery thereon.

2. The system of claim 1 comprising two additional wheels.

3. The system of claim 1, wherein the master carrier further comprises:

a plurality of openings extending through the body.

4. The system of claim 1, wherein the plate is engaged with the body via a channel.

5. The system of claim 1, further comprising:

a carrier configured to engage with the cable, the carrier having:

a carrier body with grooves;

a pendant engaged with the carrier body;

a first wheel and a second wheel attached to opposing sides of the carrier to engage with the track; and a carrier cap with a hole extending therethrough to receive the cable.

6. The system of claim 5, wherein the pendant further comprises:

a pendant body forming a socket to receive a post of a snap device to secure the drapery thereto, the pendant body having an opening extending from a bottom of the pendant body into the socket to release the post.

7. The system of claim 1, further comprising:

a snap pendant carrier having a snap pendant carrier body;

a snap pendant carrier cap configured to engage with a top of the snap pendant carrier body and engage with the cable; and a pendant with a flange to engage with the snap pendant carrier body, the pendant having a pendant body forming a socket to receive a post of a snap device to secure the drapery thereto, the pendant body having an opening extending from a bottom of the pendant body into the socket to release the post;

wherein the snap pendant horizontally engages with the snap pendant carrier body.

* * * * *